US010516235B2

(12) United States Patent
Park et al.

(10) Patent No.: US 10,516,235 B2
(45) Date of Patent: Dec. 24, 2019

(54) CONNECTING STRUCTURE OF CONNECTOR

(71) Applicants: Hyundai Motor Company, Seoul (KR); KIA Motors Corporation, Seoul (KR); Yura Co., Ltd, Hwaseong-si, Gyeonggi-do (KR)

(72) Inventors: Hyong Joon Park, Hwaseong-si (KR); Sang Chan Jeong, Seoul (KR); Han Joon Jeon, Seoul (KR); Il Kwon Park, Seongnam-si (KR)

(73) Assignees: HYUNDAI MOTOR COMPANY, Seoul (KR); KIA MOTORS CORPORATION, Seoul (KR); YURA CO., LTD, Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/118,629

(22) Filed: Aug. 31, 2018

(65) Prior Publication Data

US 2019/0288446 A1 Sep. 19, 2019

(30) Foreign Application Priority Data

Mar. 19, 2018 (KR) ..... 10-2018-0031285

(51) Int. Cl.

| | |
|---|---|
| ***H01R 13/64*** | (2006.01) |
| ***H01R 13/621*** | (2006.01) |
| ***H01R 13/52*** | (2006.01) |
| ***H01R 13/641*** | (2006.01) |
| ***H01R 13/629*** | (2006.01) |

(52) U.S. Cl.

CPC ..... *H01R 13/621* (2013.01); *H01R 13/5219* (2013.01); *H01R 13/629* (2013.01); *H01R 13/641* (2013.01)

(58) Field of Classification Search

USPC ..... 439/359, 364, 271, 272, 273, 274, 275, 439/276, 277

See application file for complete search history.

(56) References Cited

U.S. PATENT DOCUMENTS

2006/0281352 A1* 12/2006 Kabasawa ..... H01R 13/631 439/247
2013/0316572 A1* 11/2013 Ishikawa ..... H01R 13/621 439/569

FOREIGN PATENT DOCUMENTS

KR 10-2017-0035071 3/2017

* cited by examiner

*Primary Examiner* — Abdullah A Riyami
*Assistant Examiner* — Nelson R. Burgos-Guntin
(74) *Attorney, Agent, or Firm* — Brinks Gilson & Lione

(57) ABSTRACT

A connecting structure for coupling connectors includes a male connector, and a female connector connected to the male connector. The male connector includes: a base; a first terminal portion provided on an upper surface of the base; and an edge portion protruding from the upper surface of the base to surround the first terminal portion. In particular, the edge portion includes a coupling protrusion protruding from an outer surface of the edge portion. In addition, the female connector includes: a second terminal portion to be connected to the first terminal portion; an inner seal that is provided in the second terminal portion and inserted inside the edge portion; and a casing including an inner space where the second terminal portion is provided, and a coupling groove having a shape corresponding to the coupling protrusion.

7 Claims, 10 Drawing Sheets

FIG.1 "PRIOR ART"
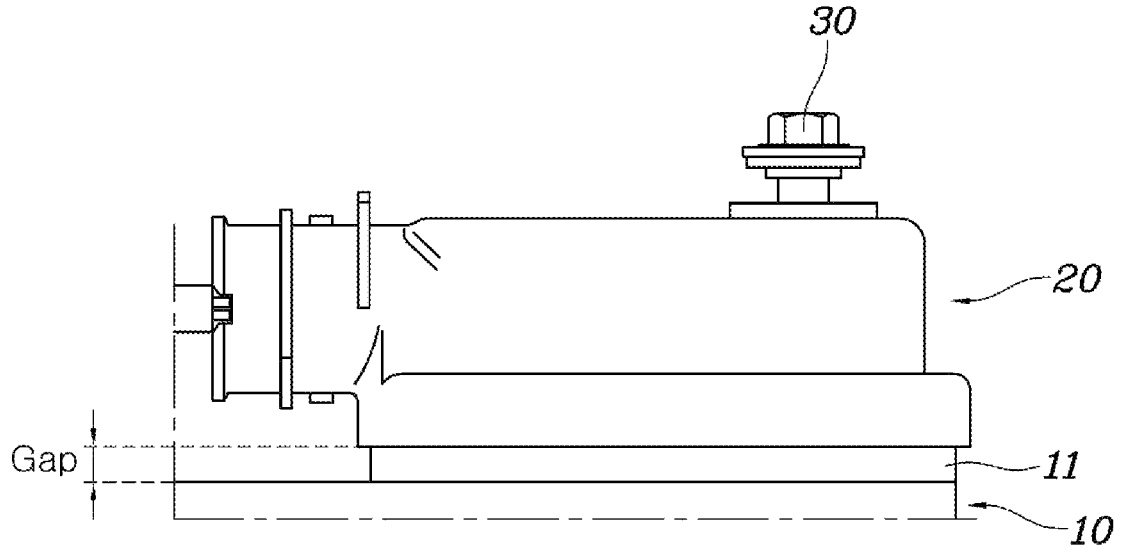
FIG.2 "PRIOR ART"
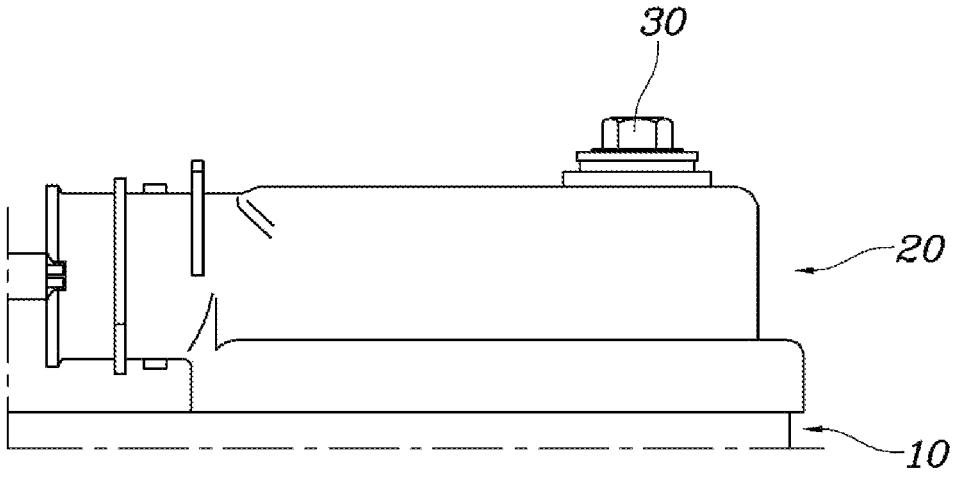

CONNECTING STRUCTURE OF CONNECTOR

CROSS REFERENCE TO RELATED APPLICATION

The present application claims priority to and the benefit of Korean Patent Application No. 10-2018-0031285, filed Mar. 19, 2018, the entire contents of which are incorporated herein by reference.

FIELD

The present disclosure relates generally to a connecting structure of a connector. More particularly, the present disclosure relates to a connecting structure of a connector, wherein the connecting structure connects a male connector and a female connector together.

BACKGROUND

The statements in this section merely provide background information related to the present disclosure and may not constitute prior art.

A connector is used to connect specific parts and transmit power or signals. A bolting connector is configured to couple a female connector to a male connector or a connector fastening unit and fasten the same using a bolt.

Here, if the female connector is not properly coupled to the male connector, the bolt may not be tightened and the connector may be disconnected during use.

FIG. 1 is a view showing a coupling of a male connector and a female connector in the conventional bolting connector.

As shown in FIG. 1, the lower end of a female connector 20 is not completely brought into contact with the upper surface of a male connector 10 when the female connector 20 is coupled to the male connector 10 and a gap is generated, a bolt 30 cannot properly fasten the two components together. Here, an edge 11 formed by extending from the upper surface of the male connector 10 is exposed.

Meanwhile, as shown in FIG. 2, when the lower end of the female connector 20 is fully brought into contact with the upper surface of the male connector 10, the bolt 30 can fasten the two components together.

However, since there is no significant difference in the appearance between the case where the male connector 10 and the female connector 20 are properly coupled together and the case where the male connector 10 and the female connector 20 are not properly coupled together, we have discovered that there is a problem that an operator cannot correctly distinguish between good and faulty product.

The foregoing is intended merely to aid in the understanding of the background of the present disclosure, and is not intended to mean that the present disclosure falls within the purview of the related art that is already known to those skilled in the art.

SUMMARY

The present disclosure provides a connecting structure of a connector that allows easy detection of defects when the female connector and the male connector are coupled together.

In one form of the present disclosure, a connecting structure for coupling connectors includes: a male connector, and a female connector to be connected to the male connector. In particular, the male connector includes: a base; a first terminal portion provided on an upper surface of the base; and an edge portion protruding from the upper surface of the base to surround the first terminal portion, and including a coupling protrusion protruding from an outer surface of the edge portion. And the female connector includes: a second terminal portion configured to be connected to the first terminal portion; an inner seal provided in the second terminal portion, and inserted inside the edge portion; and a casing configured such that the second terminal portion is provided in an inner space of the casing, and provided with a coupling groove having a shape corresponding to the coupling protrusion.

The coupling protrusion may extend outwardly from the upper surface of the base and is arranged along the outer surface of the edge portion, and the coupling groove may be formed through a side of the casing such that a lower end thereof is open.

The inner seal may be provided such that a lower end of the inner seal is disposed at a location lower than an upper end of the coupling groove.

The coupling protrusion may be provided such that an upper end of the coupling protrusion is disposed at a location lower than an upper end of the edge portion.

The coupling protrusion may be formed in an inclined shape such that a height from the upper surface of the base gradually decreases away from the edge portion.

The coupling protrusion may be provided to be spaced apart from the upper surface of the base, and the coupling groove may be formed through a side of the casing.

The coupling groove may be formed such that a lower end of the coupling groove is closed.

The casing may be configured such that an inner surface of the casing is disposed between the outer surface of the edge portion and an end portion of the coupling protrusion.

The inner seal may have a color different from a color of the casing and the edge portion.

The connecting structure in the exemplary forms of the present disclosure has the following advantages.

First, an operator can easily recognize defects when coupling the connectors.

Secondly, it is possible to inhibit or prevent breakdown and damage during use of the connector by reducing the defect rate of connector connection.

Third, since the structure is simple, it is easy to apply to a conventional connector.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIGS. 1 and 2 are views showing a conventional connecting structure of a connector;

Figure 3:
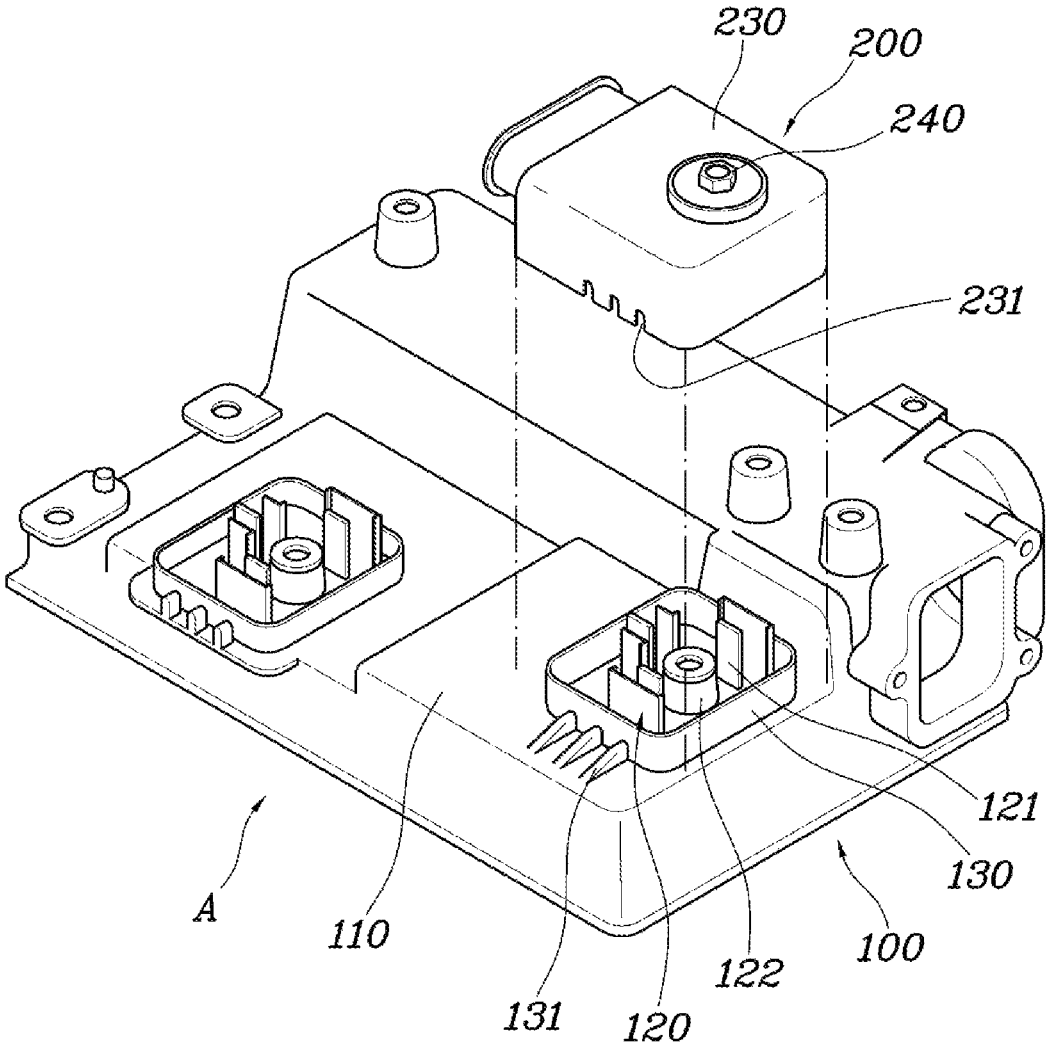
FIG. 3 is a view showing a connecting structure before connectors are assembled.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The terminology used herein is for the purpose of describing particular forms only and is not intended to be limiting. As used herein, the singular forms "a", "an", and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, a connecting structure of a connector according to an exemplary form of the present disclosure will be described in more detail with reference to the accompanying drawings.

Figure 4:
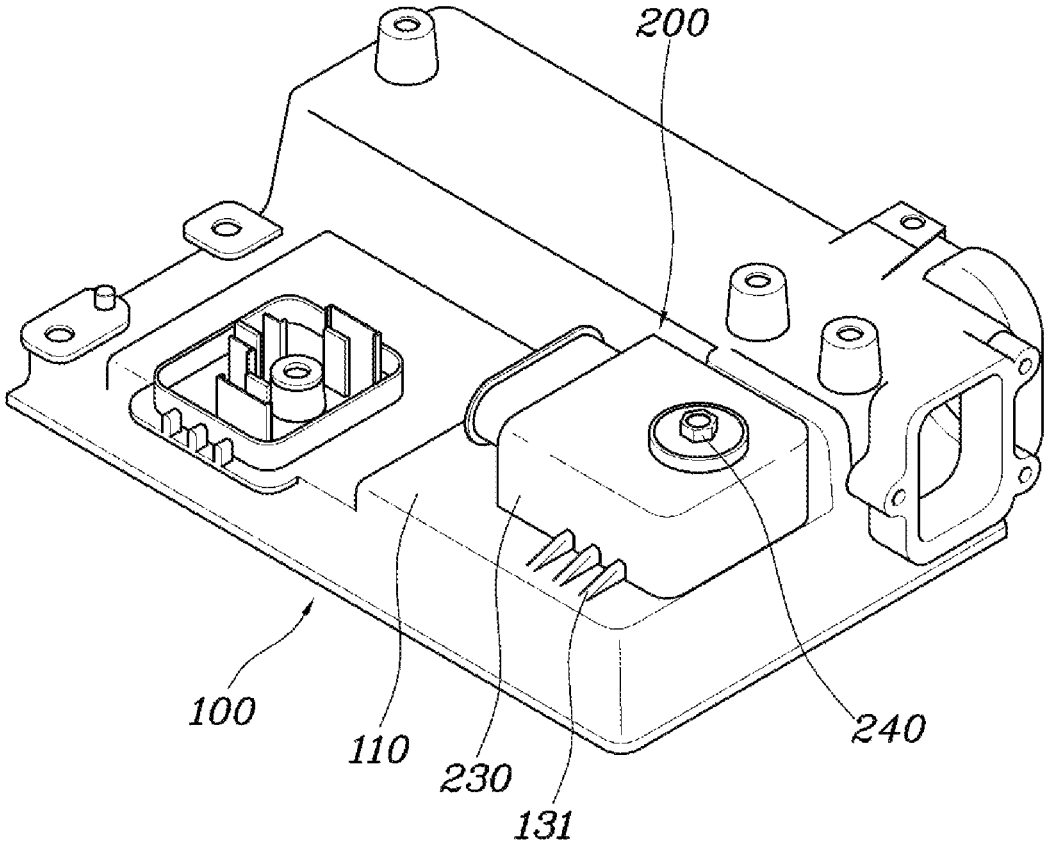
FIG. 4 is a view showing the connecting structure after the connectors are assembled.
Figure 5:
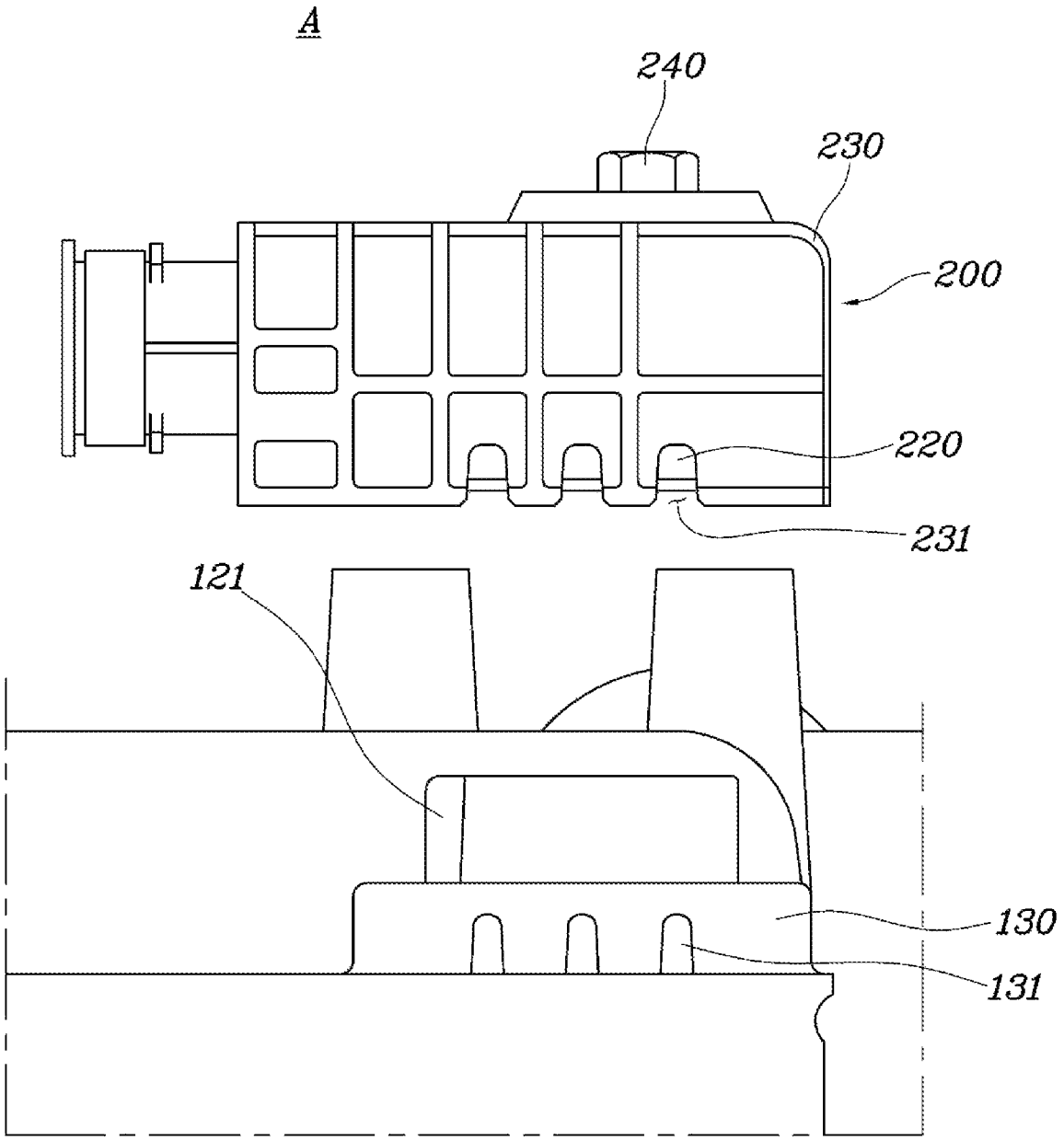
FIG. 5 is a partial view showing the connecting structure before the connectors are assembled when viewed from a different angle.
Figure 6:
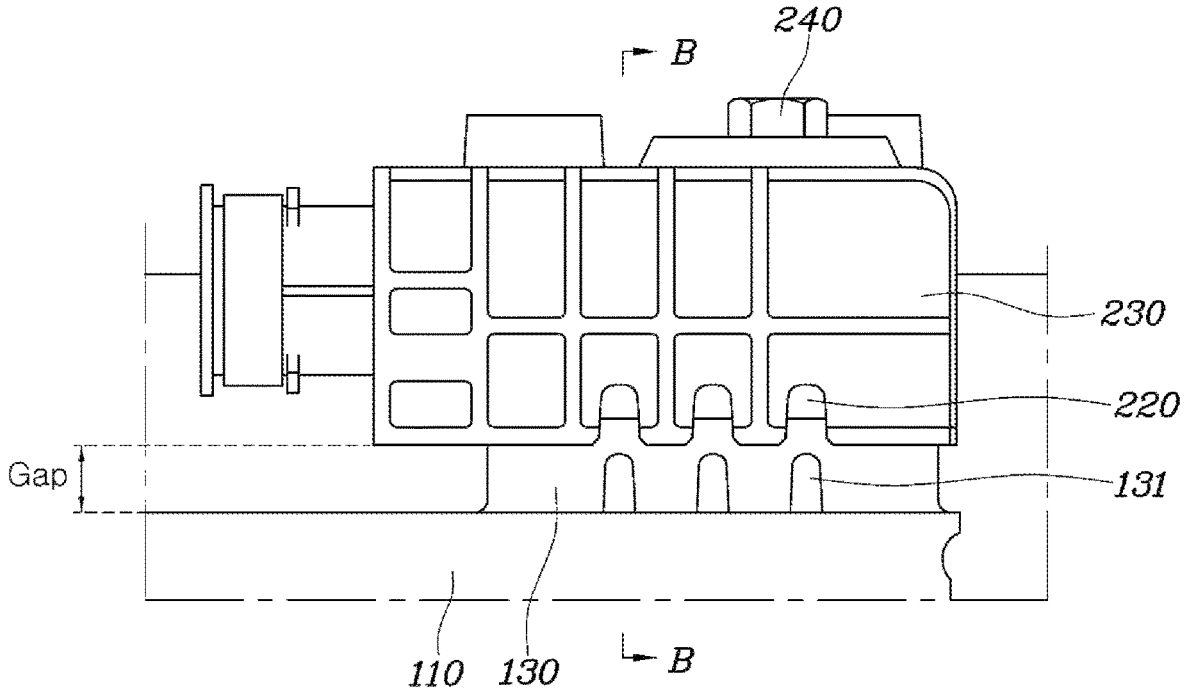
FIGS. 6 and 7 are views showing a comparison of appearance of the connecting structure with and without defects.
Figure 7:
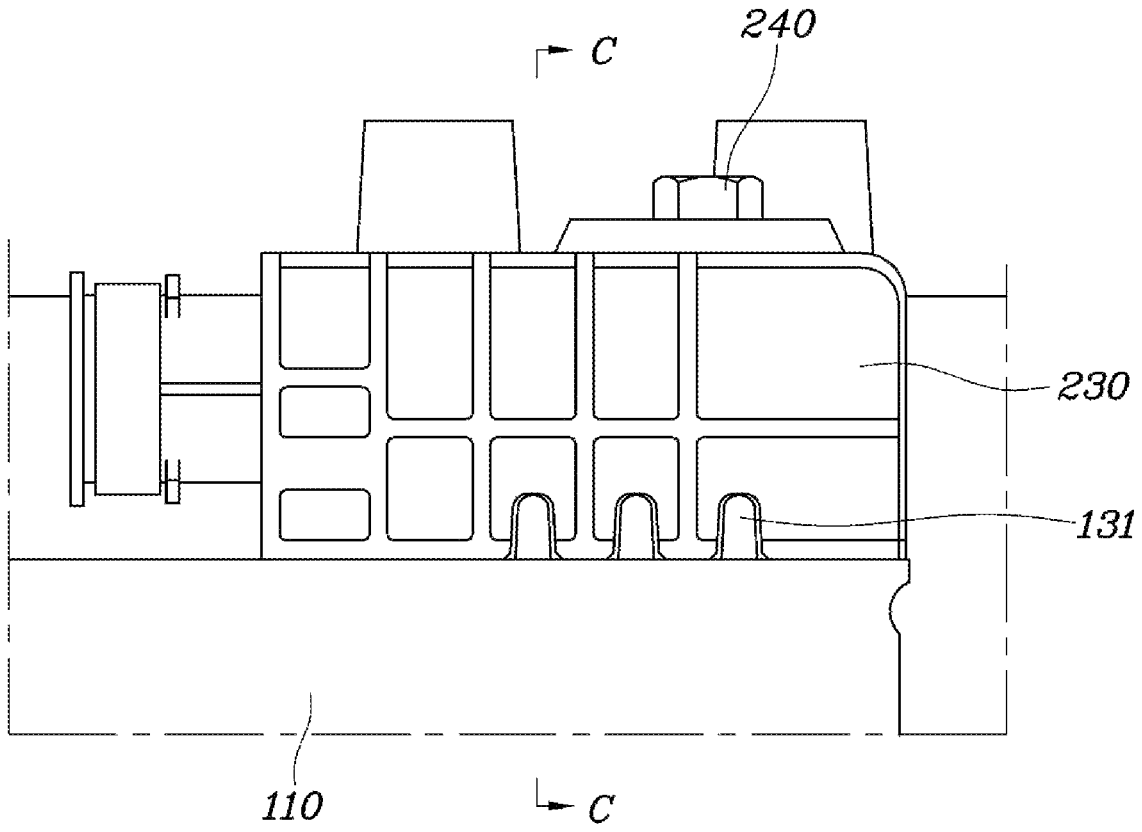
Figure 8:
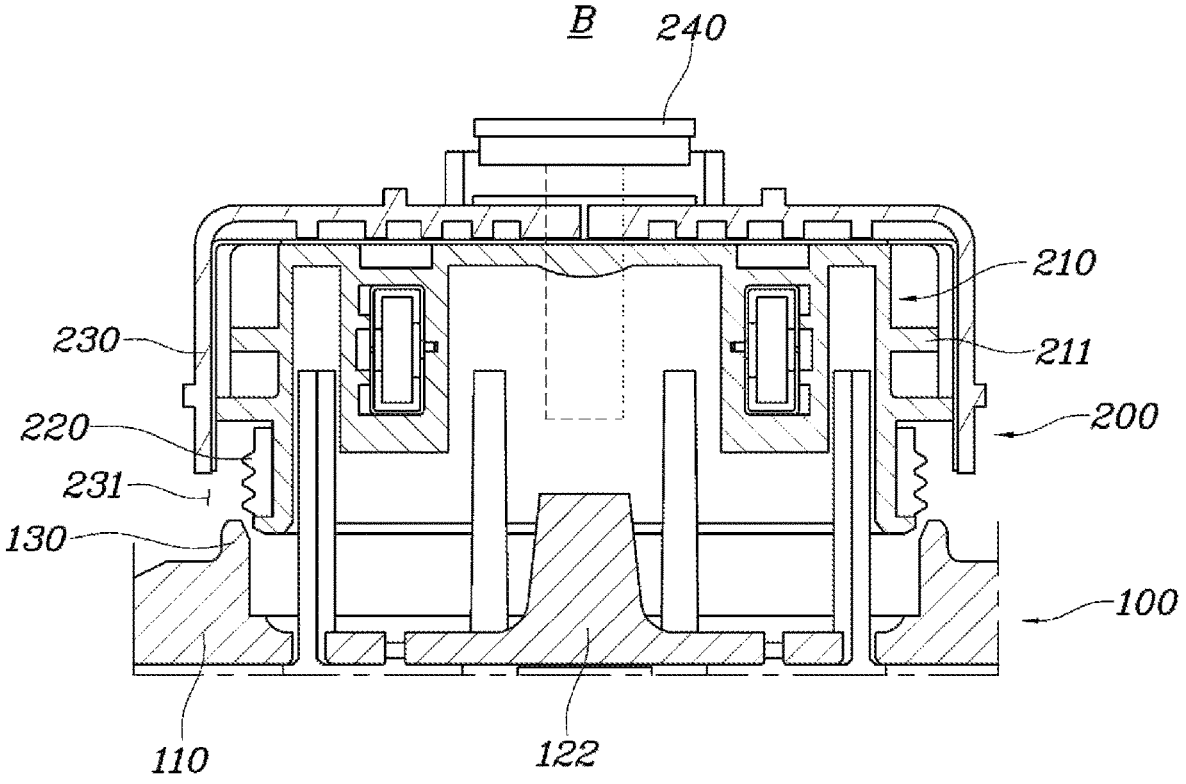
FIGS. 8 and 9 are views showing a comparison of internal shape of the connecting structure with and without defects.
Figure 9:
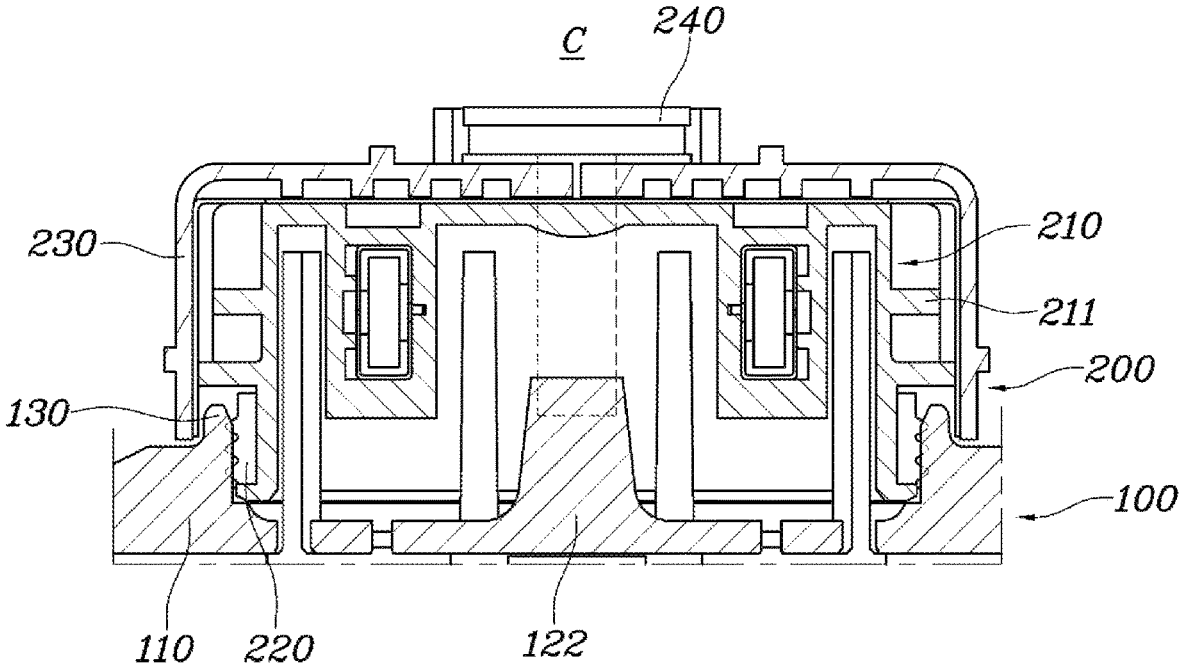
Figure 10B:
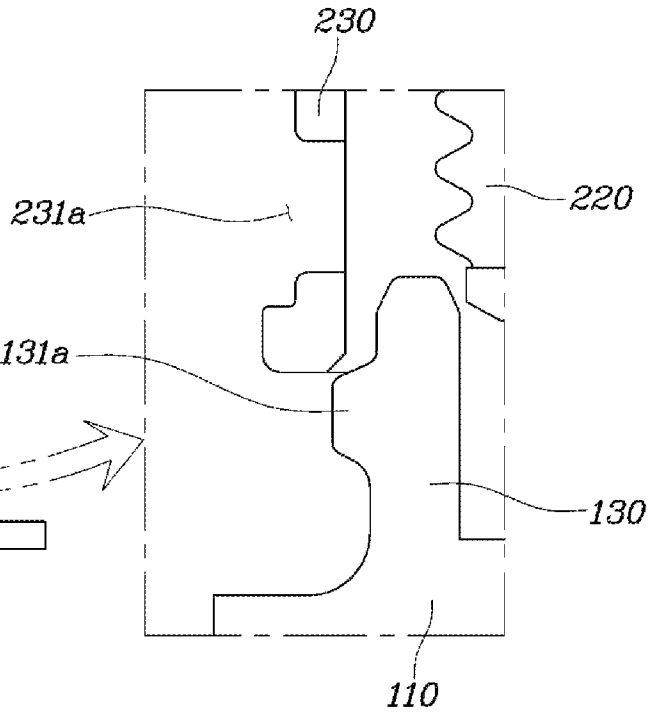
FIGS. 10A-10B and 11A-11B are views showing a connecting structure.
Figure 10A:
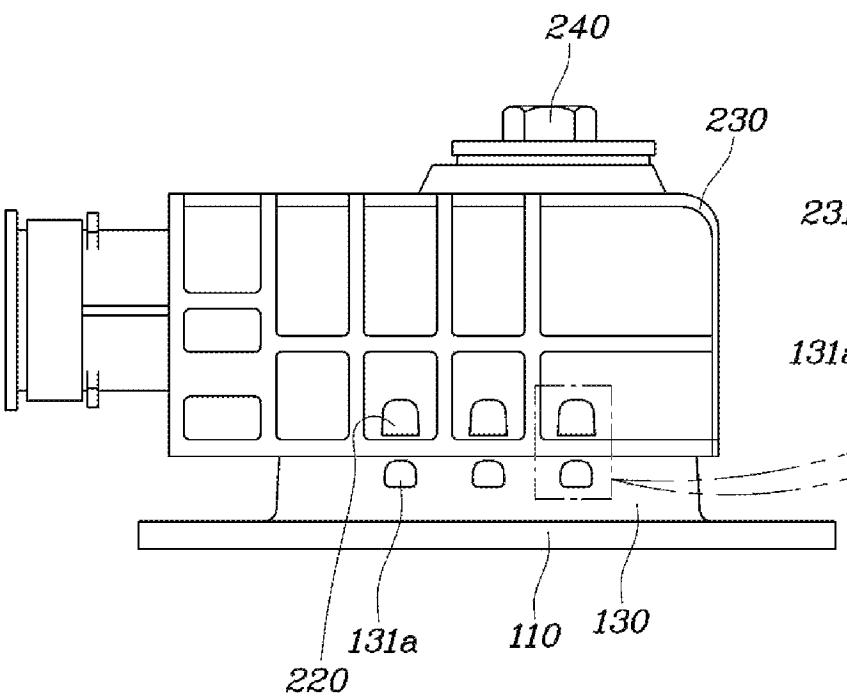
Figure 11B:
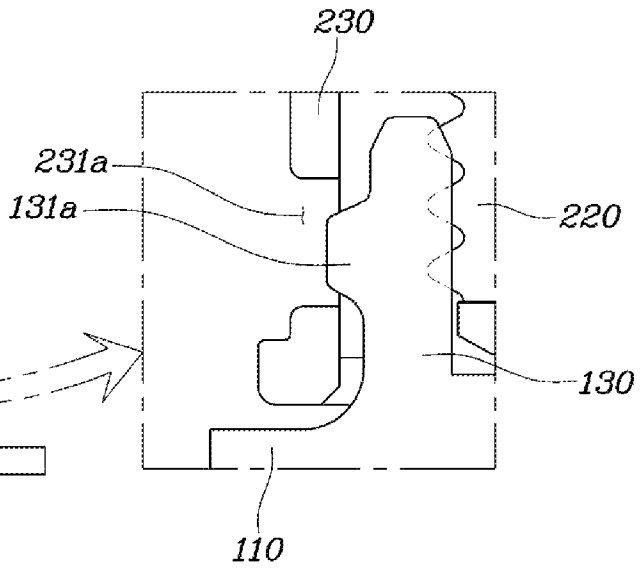
Figure 11A:
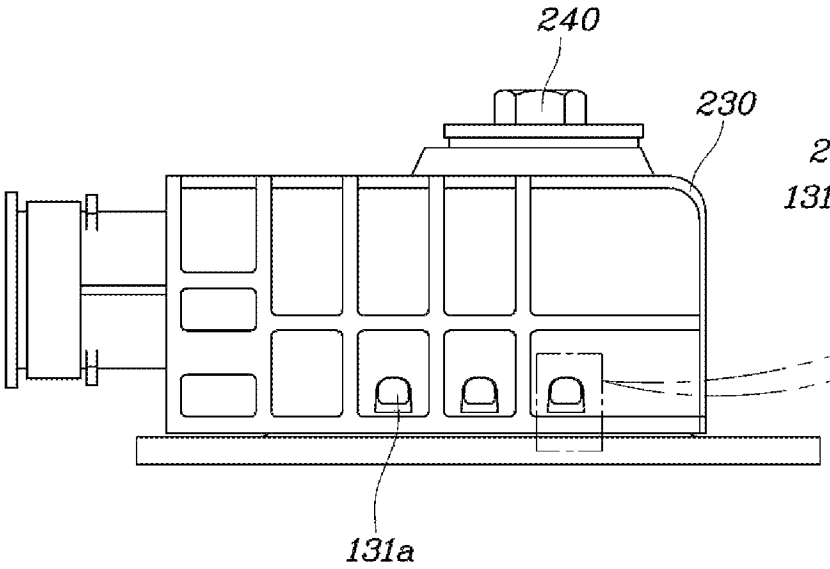

FIGS. 3 and 4 are perspective views showing states before and after assembly of a connecting structure in one form of the present disclosure. FIG. 5 is a partial side view showing the state before assembly of the present disclosure; FIGS. 6 and 7 are side views showing a comparison of the present disclosure with and without defects; and FIGS. 8 and 9 are internal sectional views showing a comparison of the present disclosure with and without defects. FIGS. 6 and 8 illustrate the state where a male connector and a corresponding female connector are improperly assembled whereas FIGS. 7 and 9 show the state where the male connector and the corresponding female connector are properly assembled without any defects such as any undesired gap.

As shown in FIGS. 3 to 9, the connecting structure of a connector according to one form of the present disclosure includes a male connector 100 and a female connector 200.

Here, the male connector 100 includes: a base 110; a first terminal portion 120 provided on an upper surface of the base 110; and an edge portion 130 protruding from the upper surface of the base 110 to surround the first terminal portion 120, and including a coupling protrusion 131 protruding from an outer surface of the edge portion. The female connector 200 includes: a second terminal portion 210 configured to be connected to the first terminal portion 120; an inner seal 220 provided in the second terminal portion 210, and inserted inside the edge portion 130; and a casing 230 configured such that the second terminal portion 210 is provided in an inner space of the casing, and provided with a coupling groove 231 having a shape corresponding to the coupling protrusion 131.

To be more specific to the configuration of the male connector 100, the base 110 is a part in which various circuits, power modules, electronic components, or wires are installed to be connected to the first terminal portion 120, and serves to entirely support the connecting structure of a connector.

The shape of the base 110 may be changed depending on the position where the connector is installed and the necessity, so that the shape of the base 110 is not particularly limited, and in one form, the upper surface thereof is formed to be flat to improve the installation convenience of the edge portion 130 and the coupling property with the female connector 200.

The first terminal portion 120 includes: one or a plurality of electrical terminals 121 protruding from the upper surface of the base 110; and a nut body 122 formed at a predetermined position so as to be bolted to the female connector 200.

The edge portion 130 is formed in a wall shape protruding from the upper surface of the base 110 to surround the periphery of the first terminal portion 120. Although the height or the shape of the edge portion 130 is not particularly limited, the edge portion 130 may be formed in a rectangular shape to improve the assemblability.

The coupling protrusion 131 protrudes from the outer surface of the edge portion 130, and it is possible to have two forms according to the shape of the coupling protrusion 131 and the shape of the casing 230 to be described hereinafter. The shape and function of the coupling protrusion 131 according to each form will be described hereinafter in more detail.

In one form of the female connector 200, the second terminal portion 210 may include: one or a plurality of electrical terminals engaged with the one or a plurality of electrical terminals 121 of the first terminal portion 120; and a housing 211 configured to support the electrical terminals. The housing 211 is formed in a housing shape with an open bottom, and the above-mentioned terminals may be installed inside the housing 211.

Meanwhile, an inner seal 220 is provided around the lower side of the housing 211. The inner seal 220 serves to seal a gap so as to inhibit or prevent foreign substances from entering a space where the first terminal portion 120 and the second terminal portion 210 are coupled while contacting the inner surface of the edge portion 130. To achieve this, in one form, the inner seal 220 may be made of an elastic material such as rubber or the like, and the outermost circumferential length of the inner seal 220 is formed to be larger than the inner circumferential length of the edge portion 130 by a predetermined length so that the inner seal 220 is inserted inside the edge portion 130 by force fitting.

The casing 230, similar to the housing 211, is formed in a housing shape with an open bottom, and the housing 211 of the second terminal portion 210 is fixedly installed therein. Here, a bolting hole is formed at a predetermined position of the upper surface of the casing 230, and a bolting hole is formed on the upper surface of the corresponding housing 211.

A bolt 240 inserted through the bolting hole is coupled to the nut body 122 through the casing 230 and the housing 211 to couple the male connector 100 and the female connector 200 together.

In one form, the color of the inner seal 220 may be different from colors of the casing 230 and the edge portion 130, which makes it easier to observe when coupling failure occurs. In other words, when the female connector 200 is not fully engaged with the male connector 100, it can be clearly seen that the coupling is incomplete when an operator observes the inner seal 220 through the coupling groove 231. The inner seal 220 has a color different from the casing 230 and the edge portion 130 so as to improve the visibility of the operator.

Hereinbelow, forms of the present disclosure will be described. In the first form of the present disclosure, as shown in FIGS. 3 to 9, the coupling protrusion 131 extends outwardly from the upper surface of the base 110 and is arranged along the outer surface of the edge portion 130, and the coupling groove 231 is formed through a side of the casing 230 such that a lower end thereof is open.

Since the coupling protrusion 131 and the coupling groove 231 are formed to be bent upward and downward so that they are engaged with each other, the operator can intuitively recognize whether the coupling protrusion 131 and the coupling groove 231 are completely engaged with each other.

Meanwhile, a lower end of the inner seal 220 may be disposed at a location lower than an upper end of the coupling groove 231, and an upper end of the coupling protrusion 131 is disposed at a location lower than an upper end of the edge portion 130.

By doing this, as shown in FIGS. 6 and 8, the inner seal 220 can be observed through the coupling groove 231 before the female connector 200 is coupled to the male connector 100. Then, as shown in FIGS. 7 and 9, when the female connector 200 is fully engaged with the male connector 100, the inner seal 220 is obscured by the edge portion 130 and the inner seal 220 cannot be observed from the outside.

In other words, it is possible to know whether the female connector 200 and the male connector 100 are properly coupled by checking whether or not the inner seal 220 can be observed through the coupling groove 231. Here, in order to facilitate the observation of the inner seal 220, the inner seal 220 may be formed in a color different from the colors of the casing 230 and the edge portion 130 to be clearly distinguished.

Further, in one form, the coupling protrusion 131 is formed in an inclined shape such that a height from the upper surface of the base 110 gradually decreases away from the edge portion 130.

By doing this, the coupling protrusion 131 can function as a kind of reinforcing rib that reinforces the rigidity of the base 110 and the edge portion 130.

In the second form of the present disclosure, as shown in FIGS. 10A-10B and FIGS. 11A-11B, a coupling protrusion 131*a* is provided spaced apart from the upper surface of the base 110, and a coupling groove 231*a* is formed through a side of the casing. Here, unlike the first form, the lower end of the coupling groove 231*a* may be closed.

In another form, an inner surface of the casing 230 is disposed between the outer surface of the edge portion 130 and an end portion of the coupling protrusion 131*a*.

The coupling groove 231*a* is formed in a hole shape and the coupling protrusion 131*a* is formed in a protrusion shape engaging with the coupling groove, and the inner surface of the casing 230 is positioned between the edge portion 130 and the coupling protrusion 131*a*, whereby when female connector 200 is coupled to the male connector 100, after the lower end portion of the casing 230 is deformed outward while coming into close contact with the coupling protrusion 131*a*, the coupling protrusion 131*a* is inserted into the coupling groove 231*a* and the deformation of the casing 230 is eliminated, and a clicking sound is generated due to the impact.

This allows the operator to clearly see that the female connector 200 and the male connector 100 are properly engaged.

Meanwhile, in one form, the lower end of the inner seal 220 is disposed at a location lower than an upper end of the coupling groove 231*a*, and in another form, the lower end of the inner seal 220 is disposed at a location lower than or equal to the lower end of the coupling groove 231*a*.

Accordingly, when the female connector 200 and the male connector 100 are not properly coupled, it is easy to recognize that the coupling failure occurs by observing the inner seal 220 through the coupling groove 231*a*.

In both forms, except for the coupling groove 231, 231*a* and the coupling protrusion 131, 131*a*, the configurations are the same, and a description thereof will be omitted.

Although exemplary forms of the present disclosure have been described for illustrative purposes, those skilled in the art will appreciate that various modifications, additions and substitutions are possible, without departing from the scope and spirit of the present disclosure.

Therefore, the forms of the present disclosure have been described for illustrative purposes, and should not be construed as being restrictive. The scope of the present disclosure is defined by the accompanying claims rather than the description which is presented above. Moreover, the present disclosure is intended to cover not only the exemplary forms, but also various alternatives, modifications, equivalents and other forms that may be included within the spirit and scope of the present disclosure.

What is claimed is:

1. A connecting structure for coupling connectors, the connecting structure comprising:

a male connector; and a female connector configured to be connected to the male connector, wherein the male connector includes:

a base;

a first terminal portion provided on an upper surface of the base; and an edge portion protruding from the upper surface of the base and configured to surround the first terminal portion, and the edge portion including a coupling protrusion protruding from an outer surface of the edge portion, and wherein the female connector includes:

a second terminal portion configured to be connected to the first terminal portion;

an inner seal provided in the second terminal portion, and contacting an inner surface of the edge portion of the male connector; and a casing configured such that the second terminal portion is provided in an inner space of the casing, and provided with a coupling groove having a shape corresponding to the coupling protrusion, wherein the coupling protrusion of the male connector extends outwardly from the upper surface of the base of the male connector and is arranged along the outer surface of the edge portion of the male connector, and wherein the coupling groove of the female connector is formed in a side of the casing of the female connector and defines an opening that is configured to receive the coupling protrusion.

2. The connecting structure of claim 1, wherein a lower end of the inner seal is disposed at a location lower than an upper end of the coupling groove.

3. The connecting structure of claim 1, wherein an upper end of the coupling protrusion is disposed at a location lower than an upper end of the edge portion.

4. The connecting structure of claim 1, wherein the coupling protrusion is formed in an inclined shape such that a height from the upper surface of the base gradually decreases away from the edge portion.

5. The connecting structure of claim 1, wherein the coupling protrusion is provided to be spaced apart from the upper surface of the base, and the coupling groove is formed through a side of the casing.

6. The connecting structure of claim 5, wherein an inner surface of the casing is disposed between the outer surface of the edge portion and an end portion of the coupling protrusion.

7. The connecting structure of claim 1, wherein the inner seal has a color different from a color of the casing and the edge portion.

* * * * *